US005557870A

United States Patent [19]

Bergman

[11] Patent Number: 5,557,870

[45] Date of Patent: Sep. 24, 1996

[54] T-SHIRT MOUNTING FRAME

[76] Inventor: Gerald H. Bergman, 36 Rolling Meadow, East Amherst, N.Y. 14051

[21] Appl. No.: 270,460

[22] Filed: Jul. 5, 1994

[51] Int. Cl.[6] ..... G09F 17/00; D06C 3/08

[52] U.S. Cl. ..... 40/603; 40/741; 38/102.1; 38/102.5; 160/372; 223/61

[58] Field of Search ..... 40/603, 604, 605, 40/739, 741; 38/102.1, 102.4, 102.5, 102.8, 102.9; 160/372, 374, 381; 223/61–65, 71

[56] References Cited

U.S. PATENT DOCUMENTS

| | | | |
|---|---|---|---|
| 389,811 | 9/1888 | Herrmenau | 38/102.8 |
| 452,727 | 5/1891 | O'Connor . | |
| 993,519 | 5/1911 | Guth . | |
| 1,082,582 | 12/1913 | Brown . | |
| 1,223,015 | 4/1917 | Woodley . | |
| 1,398,869 | 11/1921 | Roy | 49/389 |
| 1,484,418 | 2/1924 | Solomon . | |
| 1,641,705 | 9/1927 | Steuwer . | |
| 1,789,908 | 1/1931 | Raffelson . | |
| 1,938,921 | 12/1933 | Meyer . | |
| 1,941,386 | 12/1933 | Boyer . | |
| 2,448,574 | 9/1948 | Bothe | 160/372 |
| 2,549,500 | 4/1951 | McClain . | |
| 2,637,135 | 5/1953 | Karas . | |
| 2,673,418 | 3/1954 | Unwin | 38/102.91 |
| 2,682,978 | 7/1954 | Brock . | |
| 3,830,278 | 8/1974 | Packer | 40/155 X |
| 4,129,953 | 12/1978 | Eckert | 40/154 X |
| 4,519,151 | 5/1985 | Johnson | 38/102.9 |
| 4,629,101 | 12/1986 | Franklin . | |
| 4,641,441 | 2/1987 | Roth | 40/152.1 X |
| 4,821,438 | 4/1989 | Lansky et al. | 40/155 X |
| 4,942,683 | 7/1990 | Lawson | 38/102.91 |
| 4,977,696 | 12/1990 | Johansson | 40/605 |
| 4,998,363 | 3/1991 | Vilims | 40/155 X |
| 5,113,611 | 5/1992 | Rosson | 38/102.7 |
| 5,343,642 | 9/1994 | Magnusson | 40/152.1 |

FOREIGN PATENT DOCUMENTS

| | | | |
|---|---|---|---|
| 109186 | 9/1968 | Denmark | 223/71 |
| 2553772 | 6/1976 | Germany | 40/155 |
| 651047 | 4/1963 | Italy | 223/71 |

*Primary Examiner*—Peter M. Cuomo
*Assistant Examiner*—James O. Hansen
*Attorney, Agent, or Firm*—Joseph P. Gastel

[57] ABSTRACT

A T-shirt mounting frame consisting of a plurality of corner members having right angle legs with holes in one of the legs and pins in the other of the legs so that four corner members can be assembled with each other to provide a quadrilateral frame, tabs on certain of the legs for retaining a cardboard backing member within the frame, apertures in the legs for securing adjacent frames to each other after they have had T-shirts mounted thereon.

17 Claims, 3 Drawing Sheets

5
30
29
12
13
31
4B
21
27
15
16
49
50
22
26'
24
14
25
26
23
51
47
6
4A
7
a
17
7A
b
19
20

FIG. 8.
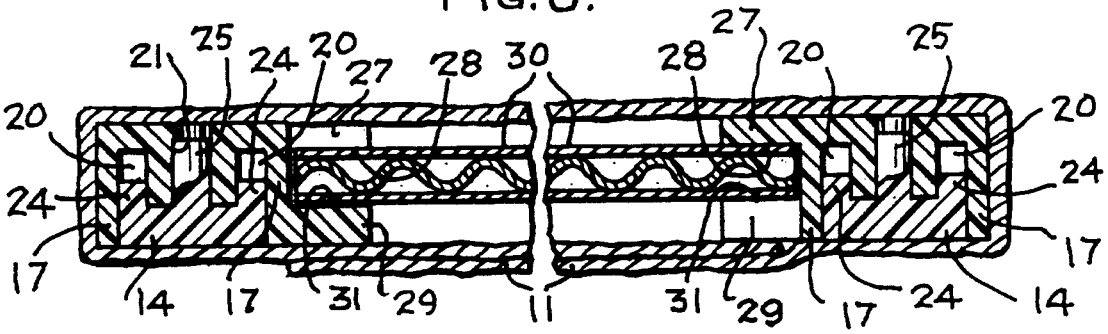
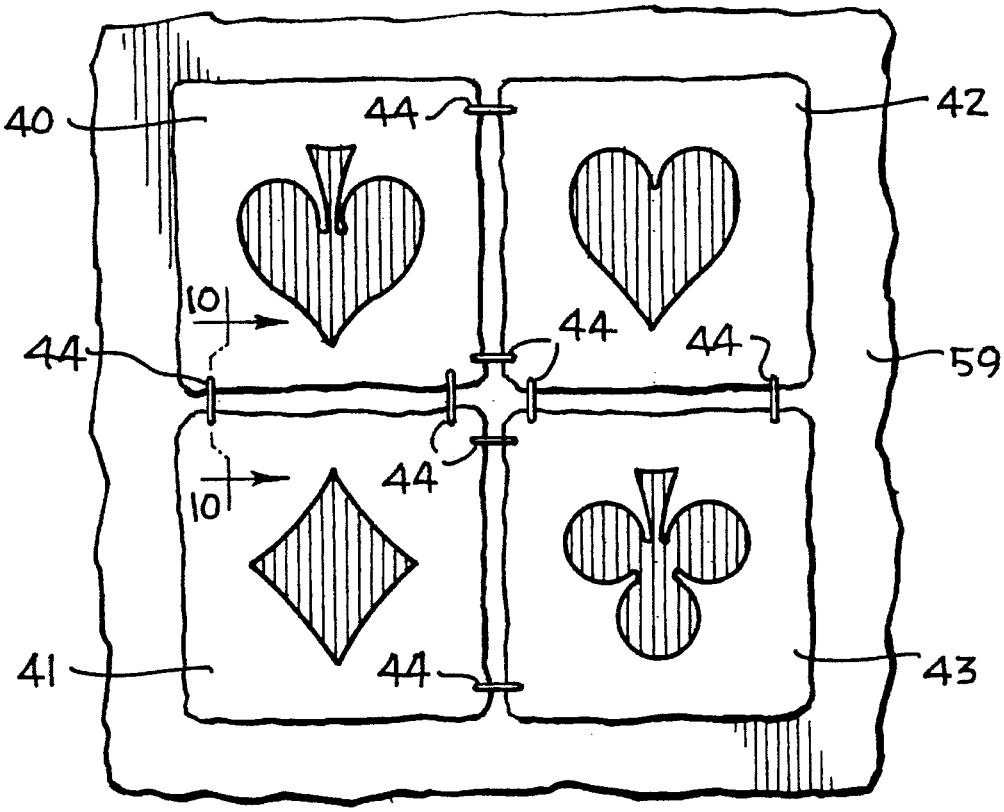
FIG. 9.
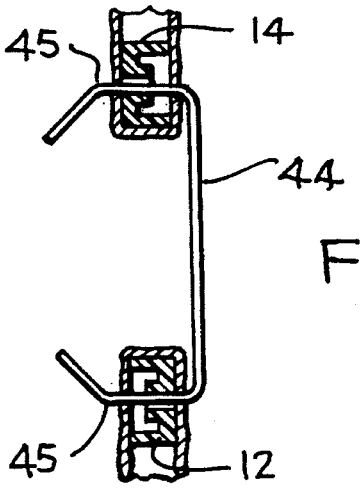
FIG. 10.

T-SHIRT MOUNTING FRAME

BACKGROUND OF THE INVENTION

The present invention relates to a combination of a T-shirt and a frame for displaying the design on the T-shirt, and it also relates to a display frame for mounting a and it also relates to an assembly of frame mounted T-shirts which can be hung on a wall, and it also relates to a stable frame construction.

By way of background, T-shirts with various types of designs are now in vogue and the designs thereon are essentially art forms which represent various occurrences, various geographical areas, various associations, and the like. Thus, some people accumulate a number of T-shirts which are either stored in drawers or in closets wherein they are not displayed.

SUMMARY OF THE INVENTION

It is one object of the present invention to provide a combination of a frame and a T-shirt mounted thereon so as to display the design on the T-shirt.

It is another object of the present invention to provide a frame structure which can be utilized to mount T-shirts for hanging on a wall to thereby display the designs on the T-shirts.

Yet another object of the present invention is to provide frame-mounted T-shirts which can be assembled with each other on a wall.

A further object of the present invention is to provide a T-shirt mounting frame which permits the design on the T-shirt to be displayed in a flat manner whereby the design can be displayed to its maximum advantage.

A still further object of the present invention is to provide a T-shirt mounting frame which is adjustable, and, when adjusted, is extremely stable so that the front of the T-shirt can be stretched across it without distorting the frame.

Yet another object of the present invention is to provide an adjustable frame construction which is extremely stable. Other objects and attendant advantages of the present invention will readily be perceived hereafter.

The present invention relates to a combination of a T-shirt and a frame for displaying a design on said T-shirt comprising a T-shirt having a first portion with a design thereon and a second portion attached to said first portion, and a frame having first and second sides with said first portion of said T-shirt containing said design being located on said first side of said frame and said second portion of said T-shirt being located on said second side of said frame.

The present invention also relates to a frame for displaying a design on a T-shirt comprising a frame having first and second sides, a plurality of frame members on said frame defining a perimeter around which a first portion of the T-shirt is placed to cause a second portion of said T-shirt containing said design to be displayed on said first side of said frame and to cause a third portion of said T-shirt to lie on said second side of said frame, and fastening means for securing portions of said third portion of said T-shirt on said second side.

The present invention also relates to an assembly of a plurality of T-shirt mounting frames each comprising a frame member defining a perimeter, first means on at least one of said frame members for mounting said at least one frame member on a wall, and second means on said frame members for securing said frame members to each other.

The present invention also relates to an adjustable frame comprising four corner members each having first and second legs which extend at right angles to each other, said first legs being wider than said second legs, said first legs having upstanding sides, a rail located between said upstanding sides, parallel slots between said upstanding sides and said rail, equally spaced holes in said rail, said second legs being of channel-shape and having a base and upstanding leg portions extending from said base for fitting into said parallel slots, and a plurality of pins extending upwardly from said base between said upstanding leg portions for insertion into said equally spaced holes, whereby said frame can be assembled in different sizes by inserting said pins of said second legs into different holes in said first legs and inserting said upstanding leg portions into said slots to stabilize each of said first and second legs relative to each other.

The various aspects of the present invention will be more readily understood when the following portions of the specification are read in conjunction with the accompanying drawings wherein:

BRIEF DESCRIPTION OF THE DRAWINGS

FIG. 8 is a fragmentary cross sectional view taken substantially along line 8—8 of FIG. 1 and showing a relationship of the backing cardboard to the frame;

FIG. 9 is a fragmentary front elevational view showing a plurality of frame-mounted T-shirts mounted on a wall and secured to each other; and FIG. 10 is a fragmentary cross sectional view taken substantially along line 10—10 of FIG. 9 and showing the clip which is used to secure adjacent frame mounted T-shirts to each other.

DESCRIPTION OF THE PREFERRED EMBODIMENTS

Figure 1:
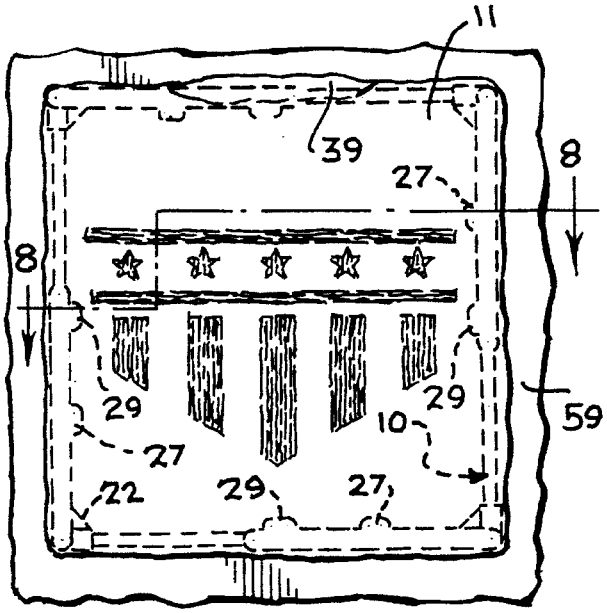
FIG. 1 is a front elevational view of a T-shirt mounted on the frame of the present invention which is mounted on a wall.
Figure 2:
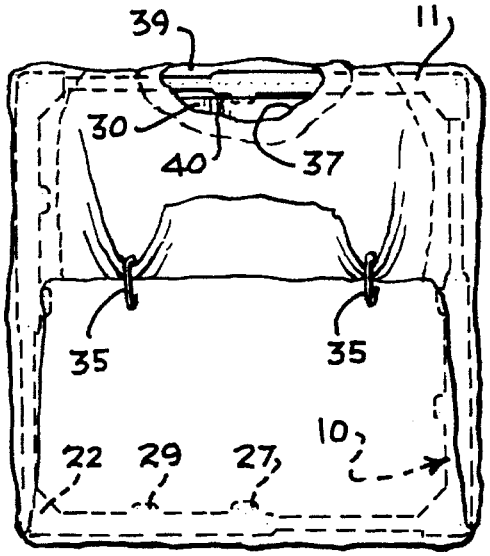
FIG. 2 is a rear elevational view of the T-shirt mounted on the frame.
Figure 3:
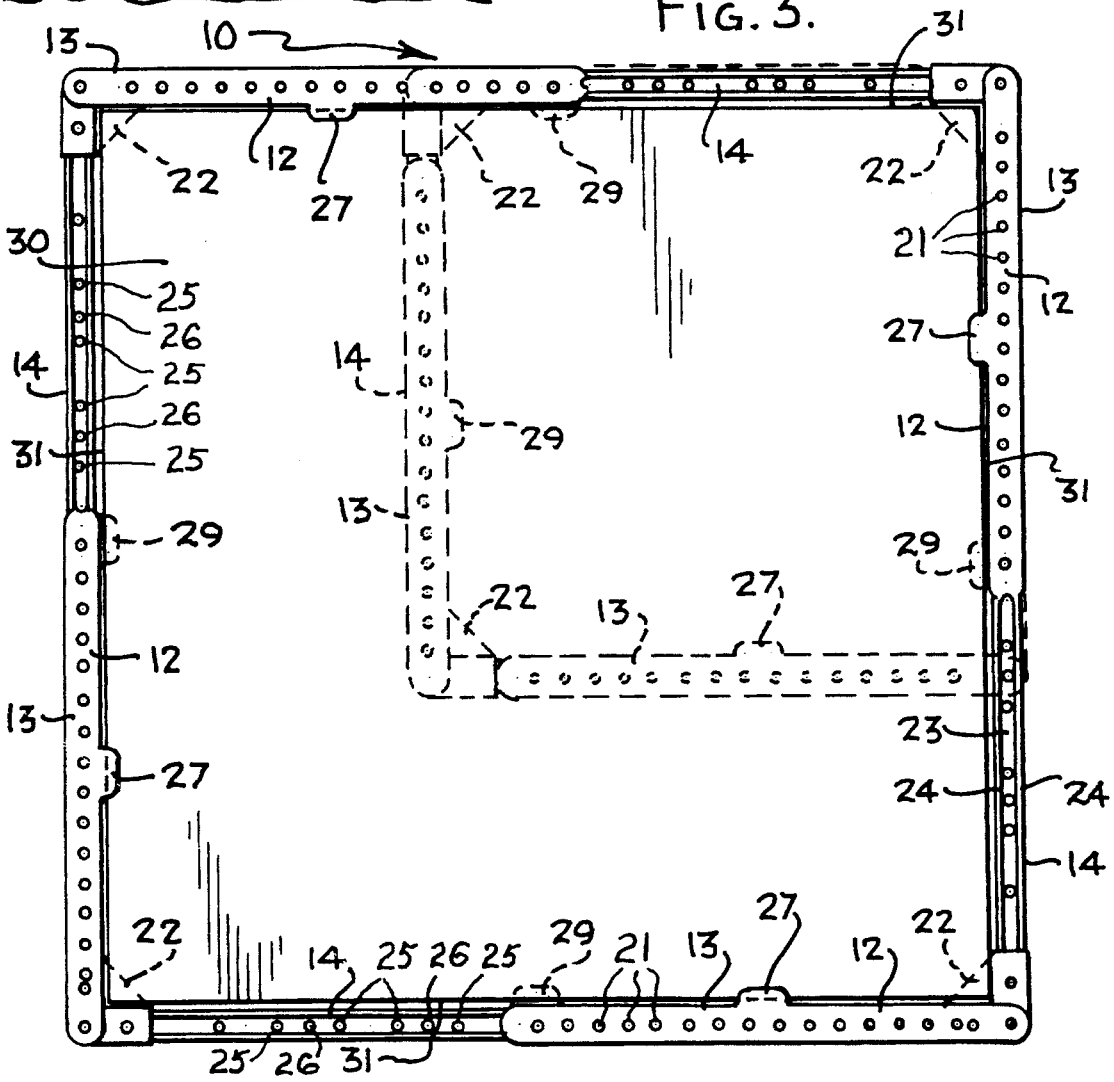
FIG. 3 is a plan view of the T-shirt mounting frame in an assembled condition and showing how it can be adjusted in size.

An assembled T-shirt mounting frame 10 is shown in FIG. 3. After a T-shirt 11 is mounted thereon, as shown in FIGS. 1 and 2, it can be mounted on a wall by itself or with other like frame-mounted T-shirts, as shown in FIG. 9.

Figures 4, 4A, 4B, 5, 6, 7, 7A:
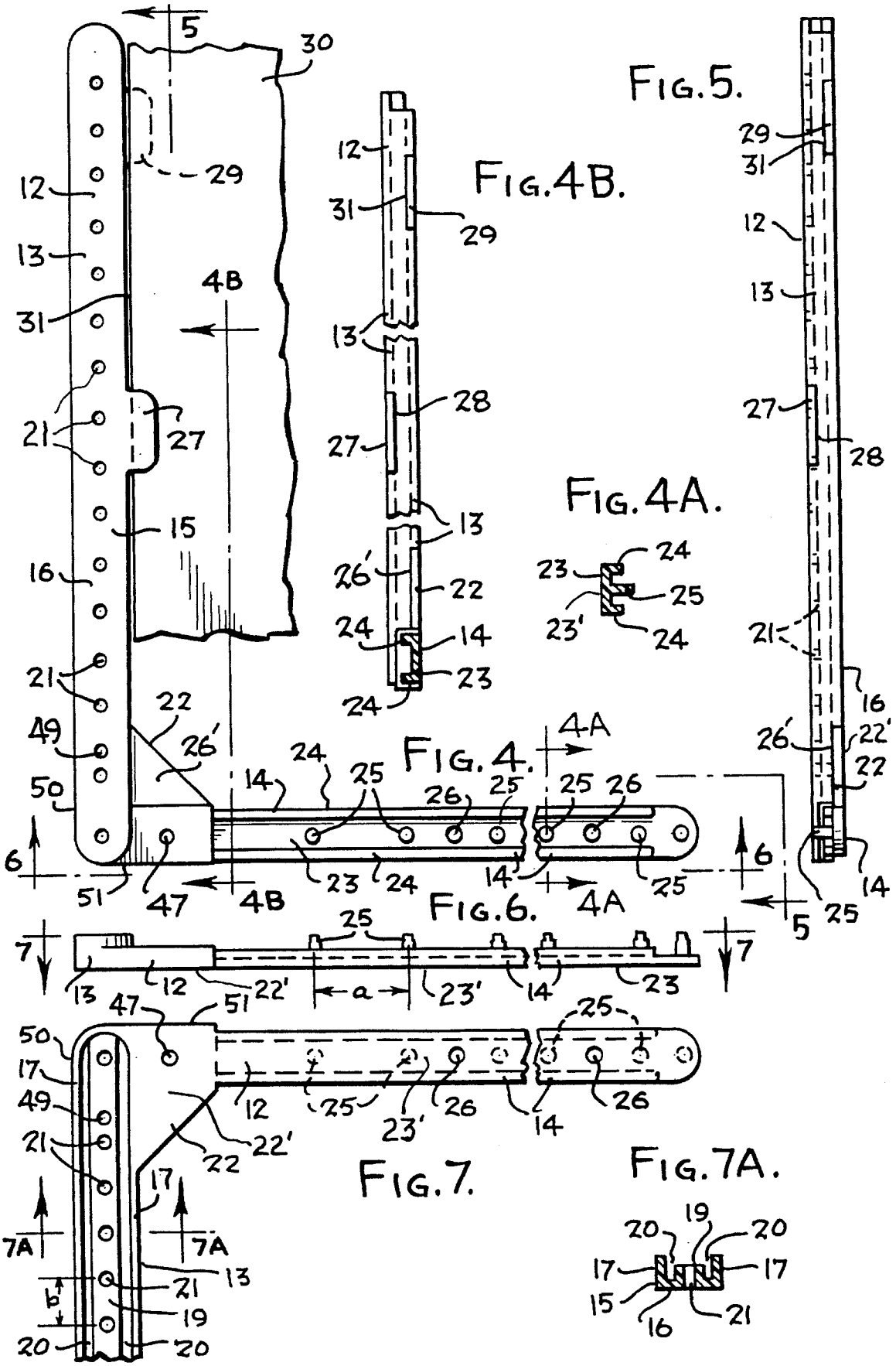
FIG. 4 is an enlarged fragmentary plan view of one of the corner members of the frame.
FIG. 4A is a cross sectional view of one of the legs of the corner member taken substantially along line 4A—4A of FIG. 4.
FIG. 4B is a fragmentary view partially in cross section taken substantially along line 4B—4B of FIG. 4.
FIG. 5 is a side elevational view taken substantially in the direction of arrows 5—5 of FIG. 4.
FIG. 6 is a fragmentary end elevational view taken substantially in the direction of arrows 6—6 of FIG. 4.
FIG. 7 is a fragmentary view taken substantially in the direction of arrows 7—7 of FIG. 6.
FIG. 7A is a cross sectional view taken substantially along line 7A—7A of FIG. 7.

The T-shirt mounting frame is assembled (FIG. 3) from four identical corner members 12 (FIG. 4). Each corner member has two legs 13 and 14. Each leg 13 consists of a channel-like portion 15 (FIG. 7A) having a base 16 and a pair of upstanding sides 17 with a rail 19 extending upwardly from base 16 between sides 17. Elongated slots 20 are located between rail 19 and legs 17. A plurality of equally spaced holes or apertures 21 are located in rail 19. Leg 13 is molded integrally with leg 14 and a gusset 22 is located at the corner thereof. Leg 14 is not as wide as leg 13. It is channel-shaped (FIGS. 4 and 4A) and it includes a base 23 (FIG. 4A) and upstanding legs 24. A plurality of equally spaced pins 25 extend upwardly from base 23, and holes 26 are also located in base 23.

A frame 10 is assembled from four corner members 12 by inserting a leg 14 of one corner member into a leg 13 of an adjacent corner member, as shown in FIG. 3. In this respect, the legs 24 (FIG. 4A) are inserted into the slots 20 (FIG. 7A) of leg 14 and the ridge or rail 19 is received between legs 24 (FIG. 8). This stabilizes the legs 13 and 14 against sidewise movement relative to each other. Additionally, to lock legs 13 and 14 securely lengthwise relative to each other, pins 25 of leg 13 are received in apertures 21 of leg 14. The assembling of four corner members 12 in accordance with the foregoing description forms a frame, such as shown in FIG. 3. The size of the frame can be adjusted from the size shown in solid lines in FIG. 3 to the size shown in dotted lines in FIG. 3 by merely varying the length of legs 14 which are received in legs 13 in the above-described manner.

A backing member in the form of a sheet of cardboard 30 is retained on frame 10 by means of tabs 27 and 29 (FIG. 4B) which are molded integrally with each of legs 13 (FIGS. 3, 4, 5, 6 and 8). The cardboard backing member 30 has its edges 31 inserted between tabs 27 and 29 to retain it within the frame. The sheet of cardboard 30 is originally provided in a size to fit in the frame in its maximum expanded condition, and it can be cut down to fit in a frame which has been adjusted to a smaller size. This adjustment is effected by varying the amounts of legs 14 which fit into legs 13. At least two pins 25 of each leg 14 should be inserted into the holes 21 of legs 13 to provide the desired stability. It will be appreciated that the more pins which are inserted into the holes 21, the greater will be the stability of the frame. It is to be noted that the pins 25 are spaced apart a distance a (FIG. 6) which is twice the distance b (FIG. 7) that the holes 21 are spaced apart. Therefore, the frame can be adjusted in increments equal to the spacing between holes 21.

The gusset 22 (FIG. 4B) is located between legs 13 and 14 and its lower surface 22' is coplanar with the lower surface 23' of base 23 (FIG. 5) of leg 14 and its upper surface 26' lies in the same plane as the upper surface 31 of tab 29 (FIG. 5). The surface 31 of tab 29 is spaced from the surface 28 of tab 27 by an amount which is equal to the thickness of the cardboard backing member 30 (see FIG. 8).

After the frame has been assembled to the proper size with the cardboard backing member 30 thereon, the T-shirt 11 is mounted on frame 10. In this respect, the frame is inserted into the T-shirt so that the front of the T-shirt lies along one side of the frame and the rear of the T-shirt lies along the other side of the frame. Thereafter, the front of the T-shirt is stretched taut, and safety pins 35 (FIG. 2) are used to pin the portions of the T-shirt at the rear of the frame together with the front of the neck 39 lying proximate the upper edge of the frame and the rear of the neck 37 of the T-shirt being spaced from the front 39 of the neck so that a hook (not shown), which is attached to the wall, can be placed in underlying relationship to the edge portion 40 (FIG. 2) of the frame, to thereby hang the frame on a wall. If desired, a plurality of spaced hooks can be placed on the wall to receive the edge 40 of the frame, to thereby give it greater stability.

It will be appreciated that when the portions of the T-shirt on the rear of the frame are pinned together, these portions will be uneven, that is, there will be lumps. However, the cardboard backing member 30 will prevent these lumps from projecting into the portion of the T-shirt containing the design on the other side of the frame. Thus, the portion of the T-shirt containing the design will lie flat.

A plurality of frames mounting different T-shirts 40, 41, 42 and 43 can be mounted on wall 59, as shown in FIG. 9. In this respect, the two upper frames mounting T-shirts 40 and 42 would be mounted on the wall in the above-described manner by hooks which receive upper edges 40 (FIG. 2). The lower shirts 41 and 43 are secured to upper shirts 40 and 42, respectively, by pins 44 (FIG. 10) which have legs 45 which can extend through holes 47 or 49 (FIG. 7) at the ends of legs 14 and 13, respectively, depending on the orientation of the frame. In this respect, hole 47 is spaced from edge 50 the same amount as hole 49 is spaced from edge 51 (FIG. 7). In addition, channel-shaped pins 44 can be used to pin the frames horizontally to each other, as is exemplified by shirts 40 and 42 and by shirts 41 and 43. As can be seen, the legs 45 of the pins extend through the fabric of the shirts and the adjacent holes 47 or 49, but the pins will not damage the fabric because they are only pins. The legs 45 of pins 44 were originally straight, but they are shown after having been bent to prevent their falling out of assembled relationship with the frames.

While preferred embodiments of the present invention have been disclosed, it will be appreciated that it is not limited thereto but may be otherwise embodied within the scope of the following claims.

What is claimed is:

1. In combination, a T-shirt and a frame for displaying a design on said T-shirt comprising a T-shirt having a first portion with a design thereon and a second portion attached to said first portion, a frame having first and second sides with said first portion of said T-shirt containing said design being located on said first side of said frame and said second portion of said T-shirt being located on said second side of said frame, and a sheet of cardboard between said first and second portions of said T-shirt for preventing said second portion of said T-shirt from moving into substantial engagement with said first portion.

2. A frame as set forth in claim 1 including means for adjusting the size of said frame to vary the amount of said second portion of the T-shirt which is located on said first side of said frame.

3. A frame as set forth in claim 1 including aperture means in said frame, and fastening means for passing through said T-shirt and into said aperture means for securing to said frame a second frame which also has a T-shirt mounted thereon.

4. A frame as set forth in claim 3 including means for adjusting the size of said frame to vary the amount of said second portion of the T-shirt which is located on said first side of said frame.

5. A frame as set forth in claim 4 including retaining means on said frame for retaining said cardboard on said frame.

6. The combination as set forth in claim 1 including securing means for retaining said cardboard on said frame.

7. A frame as set forth in claim 6 including pin means for securing portions of said second portion of said T-shirt to each other on said second side of said frame to retain said T-shirt on said frame.

8. A frame as set forth in claim 6 wherein said retaining means comprise tabs on said frame for engaging said sheet of cardboard.

9. The combination as set forth in claim 1 including securing means for securing said T-shirt on said frame.

10. The combination as set forth in claim 1 wherein said securing means comprises pins for fastening portions of said second portion of said T-shirt to each other.

11. A frame as set forth in claim 10 including retaining means for retaining said cardboard on said frame.

12. A frame as set forth in claim 11 including means for adjusting the size of said frame to vary the amount of said second portion of the T-shirt which is located on said first side of said frame.

13. A frame as set forth in claim 12 wherein said retaining means comprise tabs on said frame for engaging said sheet of cardboard.

14. An adjustable frame comprising four corner members each having first and second legs which extend at right angles to each other, said first legs being wider than said second legs, said first legs having upstanding sides, a rail located between said upstanding sides, parallel slots between said upstanding sides and said rail, equally spaced holes in said rail, said second legs being of channel-shape and having a base and upstanding leg portions extending from said base for fitting into said parallel slots, and a plurality of pins extending upwardly from said base between said upstanding leg portions for insertion into said equally spaced holes, whereby said frame can be assembled in different sizes by inserting said pins of said second legs into different holes in said first legs and inserting said upstanding leg portions into said slots to stabilize each of said first and second legs relative to each other.

15. An adjustable frame as set forth in claim 14 including tab means on said first legs for retaining a backing member in said frame.

16. An adjustable frame as set forth in claim 15 wherein said tab means comprise first and second tabs spaced longitudinally from each other along said first leg, said tabs including first and second surfaces on said first and second tabs, respectively, which are spaced apart the width of said backing member.

17. An adjustable frame as set forth in claim 14 including means on said frame for securing said frame to a like frame.

* * * * *

UNITED STATES PATENT AND TRADEMARK OFFICE

CERTIFICATE OF CORRECTION

PATENT NO. : 5,557,870

DATED : September 24, 1996

INVENTOR(S) : Gerald H. Bergman

It is certified that error appears in the above-indentified patent and that said Letters Patent is hereby corrected as shown below:

Column 1, line 7, after "mounting a" insert --T-shirt,--.

Column 4, line 65 (claim 6), change "securing" to --retaining--.

Column 5, line 8 (claim 10), change "claim 1" to --claim 9--.

Signed and Sealed this

Third Day of December, 1996

*Attest:*

Bruce Lehman

BRUCE LEHMAN

*Attesting Officer*

*Commissioner of Patents and Trademarks*